US008152584B2

(12) United States Patent
Jean et al.

(10) Patent No.: US 8,152,584 B2
(45) Date of Patent: Apr. 10, 2012

(54) COLD CATHODE FLUORESCENT LAMP AND MANUFACTURING METHOD THEREOF

(75) Inventors: Ruey-Feng Jean, Taoyuan Hsien (TW); A-Hua Chang, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 493 days.

(21) Appl. No.: 12/259,035

(22) Filed: Oct. 27, 2008

(65) Prior Publication Data

US 2009/0322204 A1 Dec. 31, 2009

(30) Foreign Application Priority Data

Jun. 30, 2008 (TW) ..... 97124507 A

(51) Int. Cl.
*H01J 9/26* (2006.01)

(52) U.S. Cl. ..... 445/25; 313/491

(58) Field of Classification Search ..... 313/623, 313/491, 627–643, 567, 111–117, 25–27, 313/318.01–318.09; 439/615, 739; 445/31, 445/38, 42, 56–57, 24, 26, 29, 22
See application file for complete search history.

(56) References Cited

U.S. PATENT DOCUMENTS

| | | | | |
|---|---|---|---|---|
| 5,898,272 | A * | 4/1999 | Mohacsi | 313/632 |
| 7,053,554 | B2 * | 5/2006 | Yasuda et al. | 313/634 |
| 2001/0038264 | A1 * | 11/2001 | Brumleve et al. | 313/565 |
| 2005/0017627 | A1 * | 1/2005 | Asai et al. | 313/491 |
| 2005/0017644 | A1 * | 1/2005 | Ono et al. | 313/633 |
| 2006/0214551 | A1 * | 9/2006 | Watanabe et al. | 313/318.01 |
| 2007/0035251 | A1 * | 2/2007 | Jean et al. | 313/633 |
| 2007/0161318 | A1 * | 7/2007 | Park | 445/26 |
| 2009/0061723 | A1 * | 3/2009 | Lee et al. | 445/26 |

FOREIGN PATENT DOCUMENTS

| | | | |
|---|---|---|---|
| JP | 62241238 | A * | 10/1987 |
| JP | 2003197147 | A * | 7/2003 |

* cited by examiner

*Primary Examiner* — Nimeshkumar Patel
*Assistant Examiner* — Donald Raleigh
(74) *Attorney, Agent, or Firm* — Muncy, Geissler, Olds & Lowe, PLLC

(57) ABSTRACT

A method for manufacturing a cold cathode fluorescent lamp (CCFL) is disclosed. The CCFL includes a light transmitting shell and an electrode disposed at one end of the light transmitting shell. The method includes the steps of exhausting a gas existing inside the light transmitting shell via a vent of the light transmitting shell, charging at least one inert gas into the light transmitting shell, and removing an amalgam, which is initially disposed in a gas adjusting instrument, into a temporal region of the light transmitting shell after the step of exhausting.

17 Claims, 5 Drawing Sheets

COLD CATHODE FLUORESCENT LAMP AND MANUFACTURING METHOD THEREOF

CROSS REFERENCE TO RELATED APPLICATIONS

This Non-provisional application claims priority under 35 U.S.C. §119(a) on Patent Application No(s). 097124507 filed in Taiwan, Republic of China on Jun. 30, 2008, the entire contents of which are hereby incorporated by reference.

BACKGROUND OF THE INVENTION

1. Field of Invention

The invention relates to a fluorescent lamp and a manufacturing method thereof, and in particular, to a cold cathode fluorescent lamp (CCFL) and a manufacturing method thereof.

2. Related Art

The cold cathode fluorescent lamp (CCFL) is a mercury discharge lamp, and electrons inside the lamp impact upon mercury vapor atoms to make the atoms enter excited states after the high-frequency and high-voltage AC power is applied. The excited mercury atoms return to ground states by emitting ultra-violet rays, and the emitted ultra-violet rays again excite the fluorescent body of the CCFL to generate the visible light.

In the early ages, the CCFL containing the mercury is manufactured by directly adding the liquid mercury to the lamp. However, the content of the mercury cannot be finely controlled in this method, and the liquid mercury has the high vapor pressure, which may contaminate the working instrument and environment so as to generate significantly negative influences on the human body. At present, the CCFL containing the mercury is manufactured by providing a lamp tube having a light emitting chamber and a mercury accommodating chamber, disposing a dollop of mercury into the mercury accommodating chamber, heating the mercury accommodating chamber to release the mercury to the light emitting chamber, and then sealing the light emitting chamber and removing the mercury accommodating chamber.

In the conventional manufacturing method, however, the mercury releasing step needs very high heating temperature, and the released amount of the mercury can only reach the maximum of 80%. Thus, the other mercury cannot be reused and has to be thrown away. Thus, the cost is increased, and the product and environment contamination is caused.

SUMMARY OF THE INVENTION

In view of the foregoing, the invention is to provide a cold cathode fluorescent lamp (CCFL) and a manufacturing method thereof, wherein an amalgam with a low melting point can be used during the manufacturing processes so that the released amount of mercury can be increased, and the cost and the contamination of product and environment can be decreased.

To achieve the above, a cold cathode fluorescent lamp (CCFL) of the invention includes a light transmitting shell and an electrode disposed at one end of the light transmitting shell. The method for manufacturing the CCFL includes an exhausting step of exhausting a gas existing inside the light transmitting shell via a vent of the light transmitting shell, a charging step of charging at least one inert gas into the light transmitting shell, and an amalgam disposing step of initially disposing an amalgam inside a gas adjusting instrument, and removing the amalgam into a temporal region of the light transmitting shell after the exhausting step.

The amalgam is disposed inside an isolated space of the gas adjusting instrument and is isolated by a stopper. The stopper is moved away after the exhausting step to make the amalgam fall into the temporal region of the light transmitting shell.

A melting point of the amalgam is lower than an operation temperature of the exhausting step. The exhausting step is preformed by using a heating instrument to heat the light transmitting shell to activate the gas absorbed onto an inner wall of the light transmitting shell, so that the activated gas is exhausted. The gas adjusting instrument and the heating instrument are integrated as a single instrument. The inert gas is argon or neon.

The method of the invention further includes, after the charging step, a sealing step of sealing the vent of the light transmitting shell. A high-temperature torch is provided to seal the vent in the sealing step.

The method of the invention further includes, after the sealing step, a mercury releasing step of heating the light transmitting shell to make the amalgam release a mercury vapor. The temperature of the mercury releasing step is lower than 500° C. The mercury releasing step is performed by using the heating instrument to heat the light transmitting shell.

The method of the invention further includes, before the mercury releasing step, an impurity gas absorbing step of sputtering a material of the electrode onto the inner wall of the light transmitting shell by using a high-voltage AC power to drive the electrode. A metal layer or metal film is formed on the inner wall adjacent to the electrode during the impurity gas absorbing step for absorbing an impurity gas. The material of the metal layer or the metal film includes nickel (Ni), molybdenum (Mo), niobium (Nb), tungsten (W), iron (Fe) or an alloy thereof.

The method of the invention further includes, after the mercury releasing step, a removing step of removing the temporal region by using the high-temperature torch, and sealing the light transmitting shell.

Preferably, the amalgam includes bismuth (Bi), tin (Sn), zinc (Zn), indium (In), lead (Pb) or a combination thereof. For example, the amalgam is a Bi—Sn—Hg alloy, a Zn—Hg alloy, a Bi—In—Hg alloy or a Bi—Pb—Sn—Hg alloy, or an amalgam with a low melting point. The weight percentage of Bi in the amalgam ranges from 4.0 to 60 wt %, the weight percentage of Sn ranges from 38 to 78 wt %, and the weight percentage of Hg ranges from 3 to 20 wt %.

In addition, the invention also discloses a cold cathode fluorescent lamp (CCFL) including a light transmitting shell, an electrode and a metal layer. The electrode is disposed at one end of the light transmitting shell. The metal layer is disposed on an inner wall of the light transmitting shell adjacent to the electrode for absorbing an impurity gas inside the light transmitting shell. The light transmitting shell is preferably a glass tube.

As mentioned hereinabove, the melting point of the amalgam used in the method for manufacturing the CCFL of the invention is not restricted by the operation temperature in the exhausting step. Thus, the amalgam with low melting point can be used, the released amount of the mercury can be increased, and the product and environment contamination can be avoided. In addition, the amalgam of the invention can be disposed inside the gas adjusting instrument, and then transferred from the gas adjusting instrument to the light transmitting shell directly after the exhausting step so as to simplify the manufacturing process. In addition, the invention further includes an impurity gas absorbing step of sputtering a material of the electrode onto an inner wall of the light transmitting shell to form a metal layer (or film), which can absorb the unnecessary impurity gas accommodated within the light transmitting shell, so that the light emitting efficiency can be enhanced.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The method for manufacturing a cold cathode fluorescent lamp (CCFL) according to a preferred embodiment of the invention will be described with reference to FIGS. 1A to 1F.

Figure 1A:
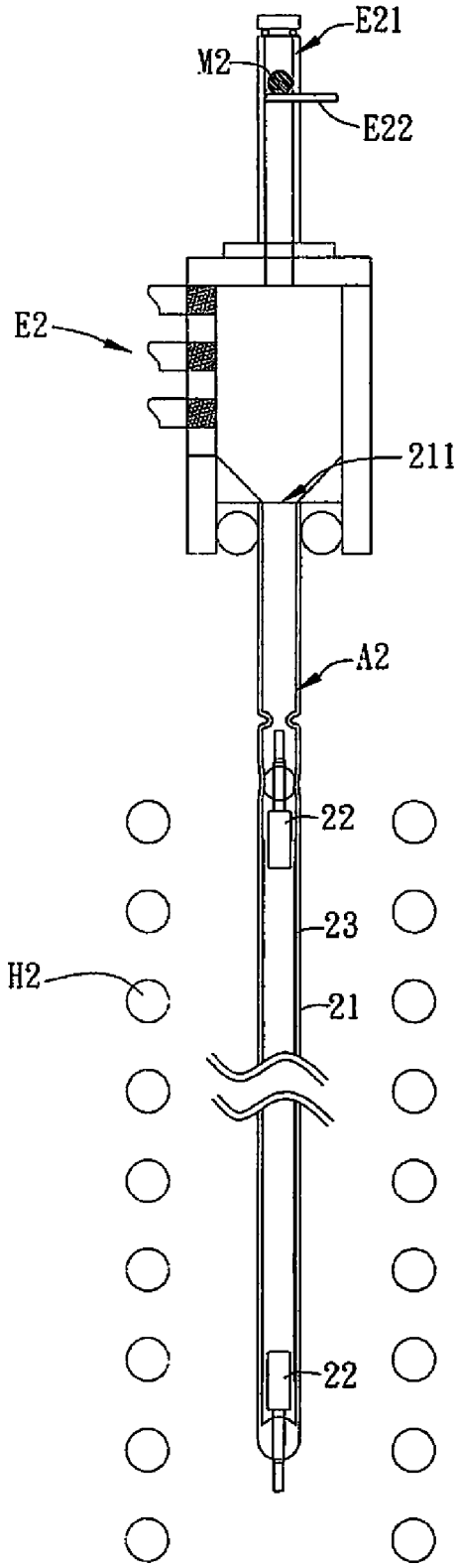
FIGS. 1A to 1F are schematic illustrations showing manufacturing processes of a cold cathode fluorescent lamp (CCFL) according to a preferred embodiment of the invention.

As shown in FIG. 1A, a light transmitting shell 21 is firstly provided. The light transmitting shell 21 has a pair of electrodes 22 disposed at two ends of the light transmitting shell 21. The light transmitting shell 21 may be a glass tube. The material of the electrode 22 may include nickel (Ni), molybdenum (Mo), niobium (Nb), tungsten (W), iron (Fe) or an alloy thereof. Of course, the material of the electrode 22 may also be any other metal or alloy. In addition, a fluorescent body 23 is further disposed inside the light transmitting shell 21 and disposed on an inner wall of the light transmitting shell 21.

The method for manufacturing the CCFL according to this embodiment includes an exhausting step of heating the light transmitting shell 21 and exhausting the gas via a vent 211 of the light transmitting shell 21. In the exhausting step, a gas adjusting instrument E2 is provided to exhaust the gas of the light transmitting shell 21, so that the impurity gas can be exhausted via the vent 211. Meanwhile, a heating instrument H2, such as an electric furnace, is provided to heat the light transmitting shell 21, so that the activated gas absorbed to the inner wall of the light transmitting shell 21 is exhausted. In addition, the gas adjusting instrument E2 and the heating instrument H2 can be integrated as a single instrument.

In this embodiment, the amalgam M2 can be disposed inside the gas adjusting instrument E2 in advance. For example, the amalgam M2 is disposed inside one isolated space E21 of the gas adjusting instrument E2 and is isolated by a stopper E22.

Figure 1B:
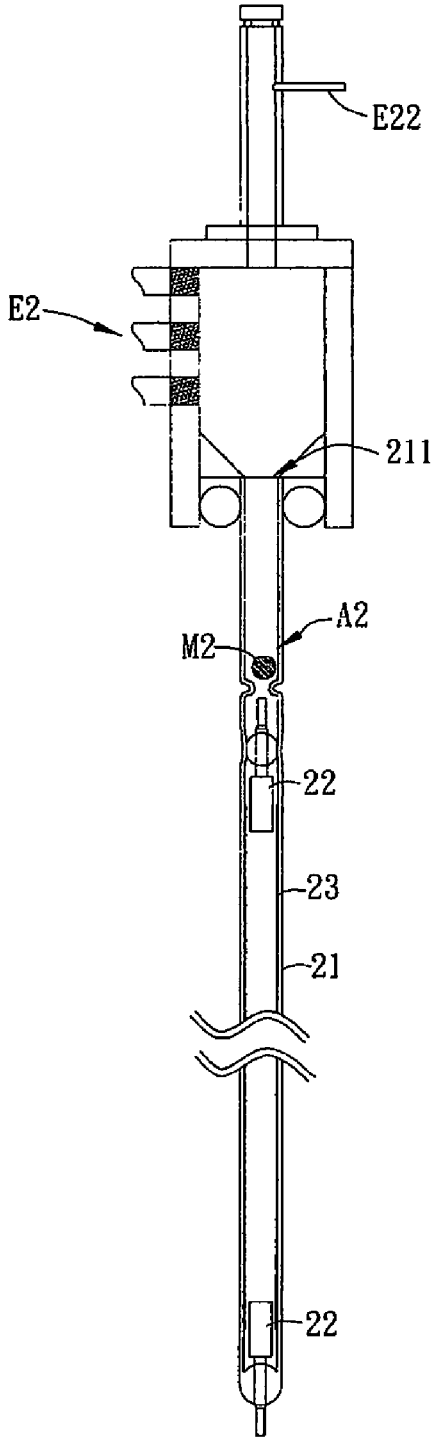

As shown in FIG. 1B, the stopper E22 is moved away after the exhausting step, so that the amalgam M2 falls into a temporal region A2 of the light transmitting shell 21. Because the amalgam M2 of this embodiment is disposed inside the gas adjusting instrument E2 in advance, the amalgam M2 directly falls from the gas adjusting instrument E2 into the temporal region A2 without any other step performed by other instrument for placing the amalgam M2. Thus, the manufacturing processes can be simplified.

The amalgam M2 of this embodiment includes bismuth (Bi), tin (Sn), zinc (Zn), indium (In), lead (Pb) or a combination thereof, such as a Bi—Sn—Hg alloy, a Zn—Hg alloy, a Bi—In—Hg alloy or a Bi—Pb—Sn—Hg alloy. Of course, any other amalgam with low melting point can also be applied to this embodiment. Taking the amalgam of Bi—Sn—Hg as an example, the weight percentage of Bi substantially ranges from 4.0 to 60 wt %, the weight percentage of Sn substantially ranges from 38 to 78 wt %, the weight percentage of Hg substantially ranges from 3 to 20 wt %, and the mercury releasing temperature is lower than 500° C. The amalgam of this embodiment has lower melting point. That is, the melting point of amalgam can be lower than the operation temperature of the exhausting step.

The method of this embodiment further includes a charging step by charging at least one inert gas into the light transmitting shell 21. In this embodiment, the gas adjusting instrument E2, which also has the charging function, is used to charge the inert gas (e.g., argon and neon) into the light transmitting shell 21 in the charging step. Of course, the charging step can also be performed by using any other charging instrument. The inert gas can form the plasma under the driving of the high-frequency high-voltage AC power.

Figure 1C:
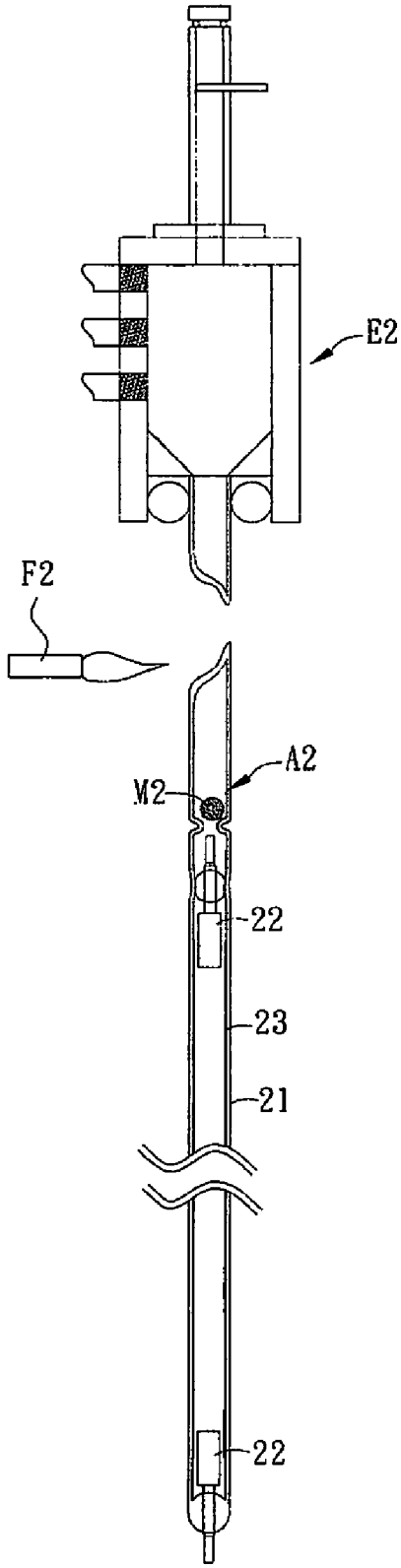

Referring to FIG. 1C, the method of this embodiment further includes a sealing step for sealing the vent 211 of the light transmitting shell 21. Herein, the vent 211 is sealed by a high-temperature torch F2.

Figure 1D:
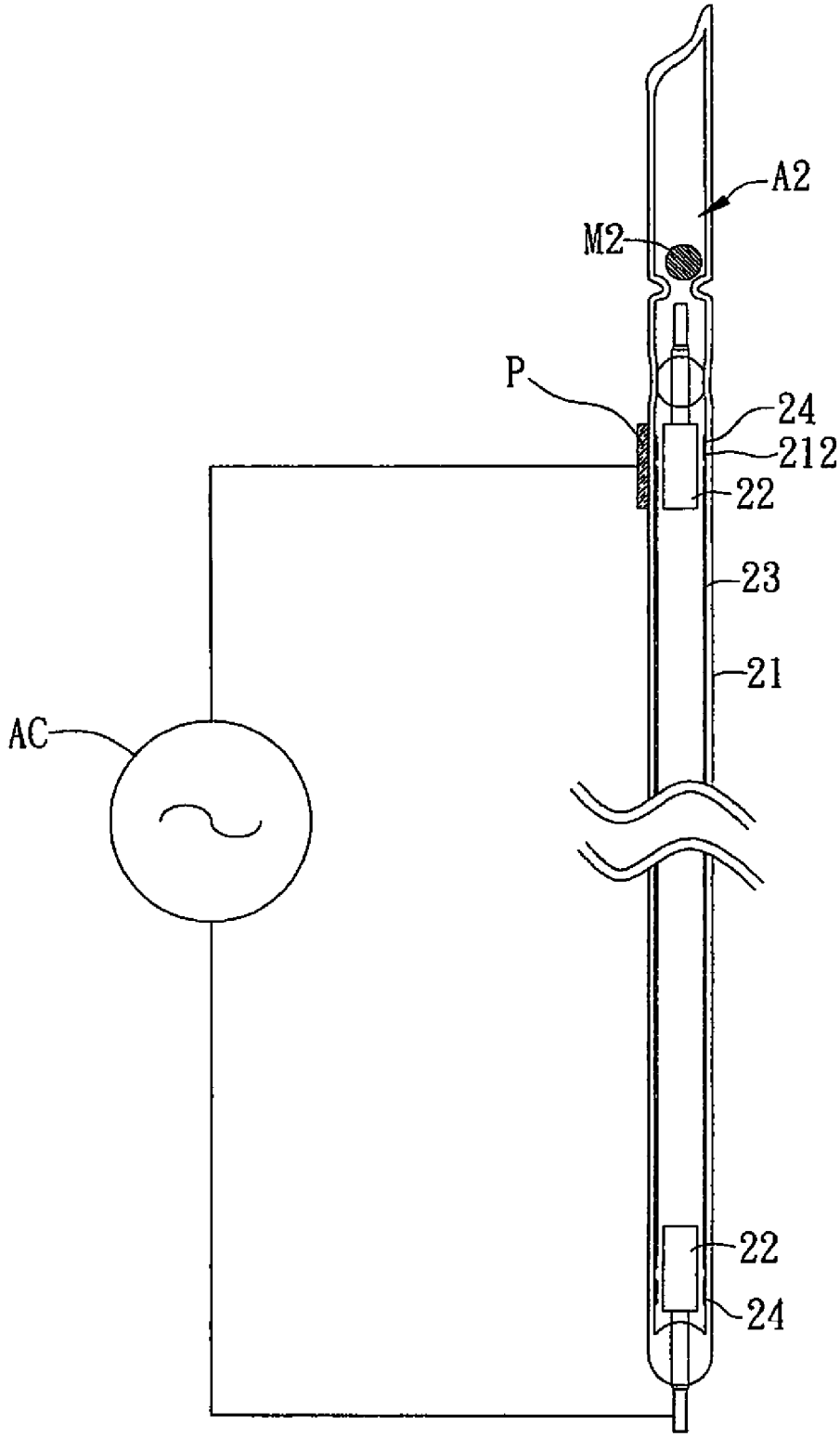

Referring to FIG. 1D, the method of this embodiment further includes an impurity gas absorbing step, in which the high-voltage AC power is provided to drive the two electrodes 22. In the embodiment, one of the electrodes 22 is disposed on the light transmitting shell 21 via an electrical connection pad P and is thus driven indirectly, so that the material of the electrode 22 is sputtered onto an inner wall 212 of the light transmitting shell 21. According to the sputtering process, it is possible to form a metal layer 24 (or metal film) on the inner wall 212 adjacent to the electrode 22, and the material thereof is the same as that of at least one part of the electrode 22. In this embodiment, the material of the metal layer 24 can include nickel (Ni), molybdenum (Mo), niobium (Nb), tungsten (W), iron (Fe) or an alloy thereof. The metal layer 24 is an activated metal layer and can be combined with the unnecessary impurity gas inside the light transmitting shell 21, so that the light emitting efficiency can be enhanced. Thus, the impurity inside the lamp can be lowered to an extent in advance and cannot be combined with the mercury after the mercury is subsequently excited. Thus, the effective mercury is decreased, and the impurity combined with the mercury is decreased. In this case, the combined impurity and mercury are deposited on the fluorescent body to decrease the light emitting efficiency.

Figure 1E:
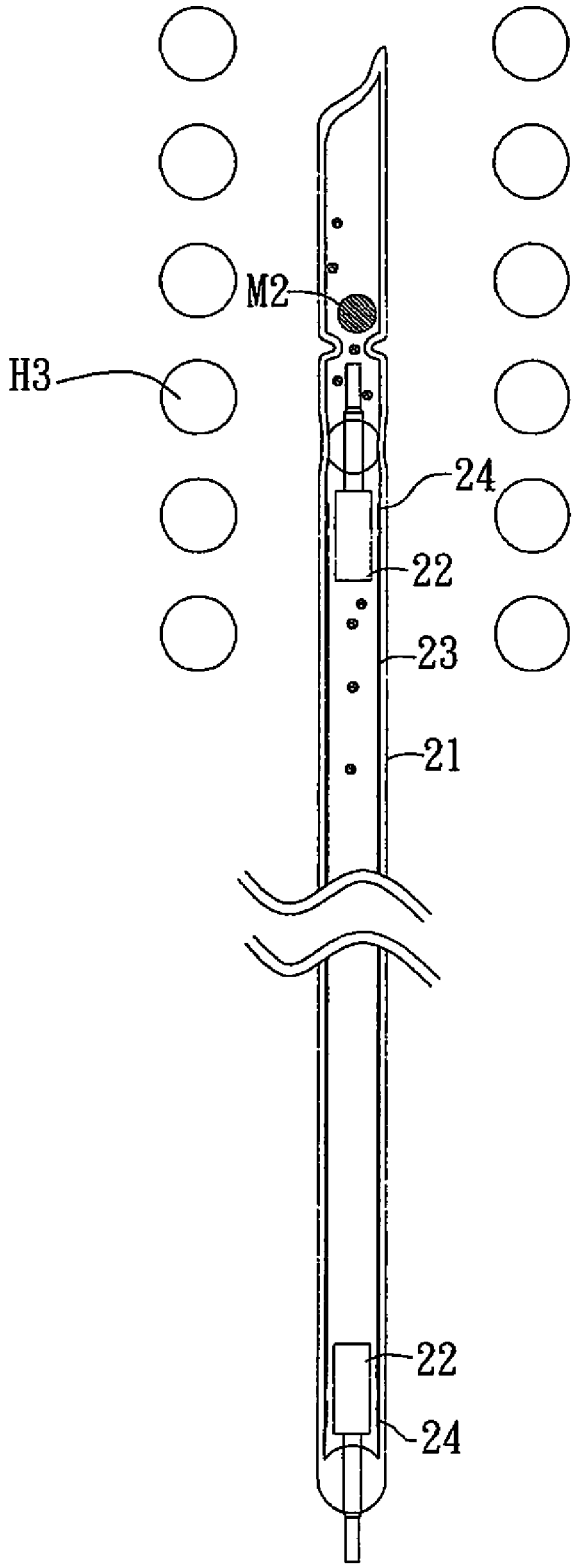

Referring to FIG. 1E, the method of the invention further includes a mercury releasing step after the impurity gas absorbing step. In the embodiment, the light transmitting shell 21 is heated so that the mercury elements of the amalgam M2 are released to from a mercury vapor. The mercury releasing step is performed by using a heating instrument H3 to heat the light transmitting shell 21. The heating instrument H3 is, for example, an electric furnace, which may be integrated with the heating instrument H2 as a single instrument. After the heating process, the mercury elements of the amalgam M2 are vaporized and migrate to the region between the two electrodes 22. The amalgam M2 used in this embodiment has lower melting point, so it is unnecessary to provide higher operation temperature for the heating process, and a mercury rushing step is not needed. Thus, the cost and the number of used instruments can be reduced, and the manufacturing processes can be simplified.

Figure 1F:
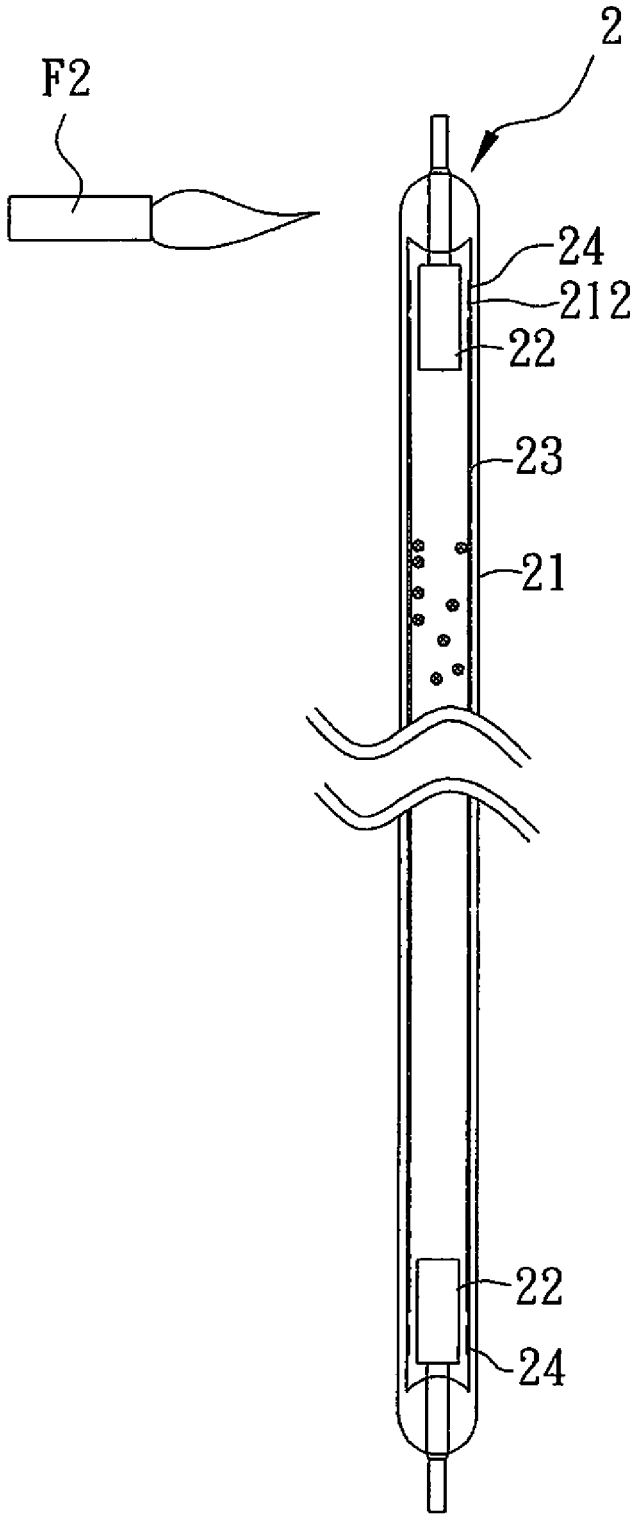

Referring to FIG. 1F the method of the invention further includes a removing step of removing the temporal region A2 after the mercury releasing step. Herein, the high-temperature torch F2 is used to remove the temporal region A2 and to make the light transmitting shell 21 form a sealed status.

Referring to FIG. 1F, a CCFL 2 according to the preferred embodiment of the invention includes a light transmitting shell 21, electrodes 22 and a metal layer 24. All of the components in the CCFL 2 have been described hereinabove, so the detailed descriptions thereof will be omitted.

In summary, the amalgam used in the method for manufacturing the CCFL of the invention has the melting point lower than the heating temperature of the exhausting step. In addition, the released amount of the mercury can be increased to avoid the product and environment contamination. In addition, the amalgam of the invention can be disposed inside the gas adjusting instrument, and then transferred from the gas adjusting instrument to the light transmitting shell directly after the exhausting step so as to simplify the manufacturing process. In addition, the invention further includes an impurity gas absorbing step of sputtering a material of the electrode onto an inner wall of the light transmitting shell to form a metal layer (or film), which can absorb the unnecessary impurity gas accommodated within the light transmitting shell. Thus, the light emitting efficiency can be enhanced.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A method for manufacturing a cold cathode fluorescent lamp (CCFL), which comprises a light transmitting shell and an electrode disposed at one end of the light transmitting shell, the method comprising steps of:

an exhausting step of exhausting a gas inside the light transmitting shell via a vent of the light transmitting shell;

a charging step of charging at least one inert gas into the light transmitting shell; and an amalgam disposing step of initially disposing an amalgam inside a gas adjusting instrument, and removing the amalgam into a temporal region of the light transmitting shell after the exhausting step, wherein after the charging step, the method further comprises a sealing step of sealing the vent of the light transmitting shell, wherein after the sealing step, the method further comprises an impurity gas absorbing step of sputtering a material of the electrode onto an inner wall of the light transmitting shell by using a high-voltage AC power to drive the electrode, wherein a metal layer or a metal film is directly formed on the inner wall of the light transmitting shell adjacent to the electrodes during the impurity gas absorbing step.

2. The method according to claim 1, wherein:

the amalgam is disposed inside an isolated space of the gas adjusting instrument and is isolated by a stopper; and the stopper is moved away after the exhausting step to make the amalgam fall into the temporal region of the light transmitting shell.

3. The method according to claim 1, wherein a melting point of the amalgam is lower than an operation temperature of the exhausting step.

4. The method according to claim 1, wherein the exhausting step is performed by using a heating instrument to heat the light transmitting shell to activate the gas absorbed onto an inner wall of the light transmitting shell, so that the activated gas is exhausted.

5. The method according to claim 4, wherein the gas adjusting instrument and the heating instrument are integrated as a single instrument.

6. The method according to claim 1, wherein the inert gas is argon or neon.

7. The method according to claim 1, wherein a high-temperature torch is provided to seal the vent in the sealing step.

8. The method according to claim 1, wherein after the impurity gas absorbing step, the method further comprises a mercury releasing step of heating the light transmitting shell to make the amalgam release a mercury vapor.

9. The method according to claim 8, wherein a temperature of the mercury releasing step is lower than 500° C.

10. The method according to claim 8, wherein a heating instrument is provided to heat the light transmitting shell in the mercury releasing step.

11. The method according to claim 1, wherein a material of the metal layer or the metal film comprises nickel (Ni), molybdenum (Mo), niobium (Nb), tungsten (W), iron (Fe) or an alloy thereof.

12. The method according to claim 1, wherein the electrode is indirectly driven through an electrical connection pad disposed on the light transmitting shell.

13. The method according to claim 8, wherein after the mercury releasing step, the method further comprises a removing step of removing the temporal region by using a high-temperature torch, and sealing the light transmitting shell.

14. The method according to claim 1, wherein the amalgam comprises bismuth (Bi), tin (Sn), zinc (Zn), indium (In), lead (Pb) or a combination thereof.

15. The method according to claim 1, wherein the amalgam is selected from a group consisting of: a Bi—Sn—Hg alloy, a Zn—Hg alloy, a Bi—In—Hg alloy or a Bi—Pb—Sn—Hg alloy, or an amalgam with a low melting point.

16. The method according to claim 15, wherein a content of Bi in the amalgam ranges from 4.0 to 60 wt %, a content of Sn ranges from 38 to 78 wt %, and a content of Hg ranges from 3 to 20 wt %.

17. A cold cathode fluorescent lamp (CCFL) manufactured by the method according to claim 1.

* * * * *